US010992080B2

(12) United States Patent
Schnieder

(10) Patent No.: US 10,992,080 B2
(45) Date of Patent: Apr. 27, 2021

(54) HIGH-CURRENT CONNECTOR COMPRISING AN INSULATING BUSH

(71) Applicant: HARTING Electric GmbH & Co. KG, Espelkamp (DE)

(72) Inventor: Stefan Schnieder, Bohmte (DE)

(73) Assignee: HARTING Electric GmbH & Co. KG, Espelkamp (DE)

( * ) Notice: Subject to any disclaimer, the term of this patent is extended or adjusted under 35 U.S.C. 154(b) by 0 days.

(21) Appl. No.: 16/645,208

(22) PCT Filed: Sep. 6, 2018

(86) PCT No.: PCT/DE2018/100761
§ 371 (c)(1),
(2) Date: Mar. 6, 2020

(87) PCT Pub. No.: WO2019/057239
PCT Pub. Date: Mar. 28, 2019

(65) Prior Publication Data

US 2020/0266577 A1 Aug. 20, 2020

(30) Foreign Application Priority Data

Sep. 22, 2017 (DE) ..... 10 2017 121 976 .5

(51) Int. Cl.
*H01R 13/53* (2006.01)
*H01R 13/58* (2006.01)

(52) U.S. Cl.
CPC ..... *H01R 13/53* (2013.01); *H01R 13/5816* (2013.01)

(58) Field of Classification Search
CPC ..... H01C 3/53; H01C 3/5816
See application file for complete search history.

(56) References Cited

U.S. PATENT DOCUMENTS

| | | | | |
|---|---|---|---|---|
| 3,753,203 | A * | 8/1973 | Link | H01R 13/53 439/95 |
| 5,011,439 | A * | 4/1991 | Pawlicki | H01R 13/187 439/847 |
| 7,540,772 | B2 * | 6/2009 | Sardi | H01R 24/545 439/581 |
| 9,825,445 | B2 * | 11/2017 | Metzler | H02G 3/088 |
| 10,305,219 | B2 * | 5/2019 | Zebhauser | H01R 24/38 |
| 2004/0177989 | A1 | 9/2004 | Nass et al. | |
| 2007/0207679 | A1 | 9/2007 | Kleinschmidt et al. | |
| 2008/0026639 | A1 * | 1/2008 | Sardi | H01R 13/533 439/607.41 |
| 2008/0311774 | A1 | 12/2008 | Sauer et al. | |
| 2009/0318019 | A1 | 12/2009 | Ellis et al. | |

(Continued)

FOREIGN PATENT DOCUMENTS

| | | | |
|---|---|---|---|
| CN | 1043228 | A | 6/1990 |
| CN | 101630782 | A | 1/2010 |

(Continued)

*Primary Examiner* — Abdullah A Riyami
*Assistant Examiner* — Nader J Alhawamdeh
(74) *Attorney, Agent, or Firm* — Smartpat PLC

(57) ABSTRACT

The connection side of a high-current connector is provided with an insulating bush which is used to maintain the required air gaps and leakage distances between current-conducting and earth-connected parts while allowing a compact installation space.

16 Claims, 3 Drawing Sheets

(56) References Cited

U.S. PATENT DOCUMENTS

| | | | | |
|---|---|---|---|---|
| 2013/0029525 | A1 | 1/2013 | Bauerle | |
| 2015/0004826 | A1 | 1/2015 | Starke | |
| 2016/0218465 | A1* | 7/2016 | Hu | H02G 3/0616 |
| 2017/0077688 | A1 | 3/2017 | Metzler et al. | |
| 2017/0229793 | A1 | 8/2017 | Schmidt et al. | |
| 2018/0261954 | A1* | 9/2018 | Zebhauser | H01R 13/53 |
| 2018/0269615 | A1* | 9/2018 | Simmonds | H01R 13/426 |
| 2020/0266577 | A1* | 8/2020 | Schnieder | H01R 13/5816 |

FOREIGN PATENT DOCUMENTS

| | | | |
|---|---|---|---|
| CN | 202503145 | U | 10/2012 |
| CN | 104011937 | A | 8/2014 |
| CN | 203774495 | U | 8/2014 |
| DE | 10311473 | | 8/2004 |
| DE | 202006003204 | U1 | 5/2006 |
| DE | 102010014982 | A1 | 10/2011 |
| DE | 202011101574 | U1 | 9/2012 |
| DE | 102014112701 | A1 | 3/2016 |
| EP | 1925060 | B1 | 5/2016 |
| WO | 2014084052 | A1 | 6/2014 |
| WO | 2015185511 | A2 | 12/2015 |

* cited by examiner

HIGH-CURRENT CONNECTOR COMPRISING AN INSULATING BUSH

TECHNICAL FIELD

The disclosure relates to a high-current connector.

BACKGROUND

Connectors are required, in principle, in order to reversibly connect electrical lines or connections to one another. In general, connectors and mating connectors are used in order to establish an electrical and mechanical connection between two electrical conductors or an electrical conductor and a device or an installation.

In particular, high-current connectors are required in order to transmit a particularly high electric current of, for example, more than and including 100 amperes (A), in particular more than and including 200 A, preferably more than and including 400 A and, in particular, an electric current of more than and including 600 A and, in some cases, possibly even of up to 800 A and more by means of a high-current contact element which forms part of the high-current connector, for example by means of a pin contact or a socket contact. In this case, the high-current connectors can carry voltages of several thousand volts (V), that is to say, for example, at least 2000 V, in particular at least 3000 V, for example 4000 V and more, that is to say, for example, up to 4800 V or even more, with respect to their ground potential. The ground potential can in this case be applied at least to a cable gland of the high-current connector and, in particular, to an at least partially metal connector housing for shielding and/or grounding purposes.

The pin and/or socket contacts of the high-current connector can have an outside and, respectively, inside diameter of more than 1 cm, for example at least 1.5 cm, preferably at least 2 cm, particularly preferably at least 2.5 cm or in some cases even of 3 cm and more. The electrical conductors of the high-current cables, which electrical conductors are connected to high-current contact elements of this kind, can be, for example, a cross-sectional area of at least 70 $mm^2$, in particular at least 95 $mm^2$, preferably at least 120 $mm^2$, particularly preferably 150 $mm^2$, that is to say, for example, 185 $mm^2$ and more. Said electrical conductors are generally stranded conductors. A stranded conductor of this kind can be connected, on the cable connection side, to the respective connection region of a high-current contact element, for example crimped to a crimp connection or, for example, screwed to an axial screw connection which is known from the prior art, in order to produce a reliable and low-impedance electrical contact in this way.

High-current connectors of this kind are used, for example, in the rail sector. Applications in power plants, transformer stations, industrial installations and high-power distribution systems are also common.

DE 20 2006 003 204 U1 describes a connector which is in the form of a plug or add-on housing. The connector comprises a connector housing in which an insulating body with electrical contacts is accommodated. The electrical contacts are provided for connecting electrical lines which are routed out of the plug or add-on housing on the rear side of the connector.

DE 10 2010 014 982 A1 discloses a connector for electrically connecting a cable. The connector has a connector housing in which a multipartite shielding element is arranged. In this case, the shielding element serves to make electrical contact with a cable shield and to electrically connect the cable shield to the connector housing.

DE 10 2014 112 701 A1 describes a high-current plug-in contact, the crimping region of which is formed from aluminum and the plug-in region of which is formed from copper, in order to reduce electrical problems when connecting a high-current aluminum cable to a high-current copper cable or a high-current copper contact in the region of the material transition. A shape and a function of a high-current connector/a high-current contact element are also implicitly explained in this context.

The problem of often relatively large so-called "clearances and creepage paths" being produced in high-current connectors, in particular on account of the abovementioned high voltages of, for example, up to 4800 V and more which are often carried by them, is generally encountered in the prior art. These clearances and creepage paths can result in undesired short circuits between the live parts of the high-current connector and those parts of the high-current connector which are actually electrically isolated from said live parts and are at ground potential by way of a so-called electrical "creepage current" flowing and/or by way of voltage dips, such as spark flashovers, occurring.

In addition to said high electrical voltages, the cause of these voltage dips/spark flashovers and creepage currents can be considered to be, amongst other things, the electrical conduction behavior of the surfaces of insulators and also the air which is located between these parts. The basic problem with clearances and creepage paths of this kind is well known to a person skilled in the field of high-current/high-voltage technology. The consequence for the high-current connector is usually that the installation space for the high-current connector has to be large enough to maintain the requisite clearances and creepage paths and in this way to avoid said flashovers and creepage currents.

One disadvantage of the known high-current connectors is the resulting large space requirement. Although this is necessary for maintaining sufficiently large clearances and creepage paths on the one hand, on the other hand it is inconsistent with the general desire for as compact a design of the high-current connector as possible. In practice, high-current connectors which have as low a height as possible in the insertion direction are often required in particular.

The German Patent and Trademark Office has searched the following prior art in the priority application for the present application: EP 1 925 060 B1 and DE 20 2011 101 574 U1.

SUMMARY

An object of the disclosure is to provide as compact a design for a high-current connector as possible, by way of which design the requisite clearances and creepage paths are maintained at the same time.

The object is achieved by the connector as claimed.

A high-current connector has a connector housing and a metal high-current contact element. The high-current connector has a plug-in side and a connection side. The high-current contact element is arranged in the interior of the connector housing. The high-current contact element has a plug-in region and a connection region, it being possible for an electrical conductor, in particular a stranded conductor, of an electrical high-current cable to be connected to said connection region. The electrical high-current cable can be fastened to the connection side of the high-current connector by means of a cable fastening, in particular a cable gland.

The high-current connector has an insulating bush which is fastened or at least can be fastened to its connection side. This insulating bush is distinguished in that it has a hollow-cylindrical section at a first end, specifically on the cable connection side. The inside diameter of the insulating bush increases in the direction of an opposite, specifically housing connection-side, end, as a result of which the insulating bush has a funnel-like fastening section on the housing connection side.

In a preferred refinement, the high-current cable described below is connected or at least can be connected to the high-current connector.

The current-carrying electrical conductor of the high-current cable is surrounded by an insulation. In this case, the electrical conductor preferably comprises cable strands, and therefore said electrical conductor is a stranded conductor and the insulation surrounding said electrical conductor is a stranded insulation which is also referred to as such in the text which follows.

In the normal state, the stranded insulation of the high-current cable is surrounded by a shielding braid which, for its part, is sheathed by an outer sheath. The outer sheath is also preferably formed from an insulating material or has at least one insulating outer layer. For the purpose of connection to the high-current contact of the high-current connector, the high-current cable can initially be "stripped of sheathing" on the housing connection side, that is to say the outer sheath is removed from that end of the high-current cable which is to be connected.

The shielding braid is then usually bent away through 180° from that end of the high-current cable which is to be connected, and, in the cable fastening, in particular the cable gland, can be fastened, for example screwed, together with the further high-current cable, to the preferably at least partially metal, but possibly also electrically insulating, connector housing, and possibly electrically conductively connected to said connector housing.

The connection-side end of the high-current cable is finally stripped of insulation, that is to say the stranded insulation is removed from the connection side end, in order to render possible connection of the stranded conductor to the high-current contact element.

On the housing connection side, the insulating bush can be attached, by way of its funnel-like fastening section, to the connector housing.

To this end, the insulating bush can preferably be inserted, by way of its fastening section, into the connector housing. In addition, the insulating bush can latch into the high-current connector for example. As an alternative or in addition, the insulating bush can be placed into a negative shape of the insulating bush that is formed in the interior of the connector housing. Furthermore, an integral design of the connector housing and the insulating bush is also conceivable. In this case, the connector housing and the insulating bush are produced in a common method. A further possible configuration involves the insulating bush latching onto the connector housing, preferably in conjunction with a rubber and/or plastic seal and/or a rubber and/or plastic overlap.

On the cable connection side, the insulating bush can be pushed, by way of its hollow-cylindrical section, onto the high-current cable, in particular onto its stranded insulation.

In this case, the insulating bush, by way of its hollow-cylindrical section, rests on the stranded insulation in that region of the high-current cable which is stripped of sheathing, and can be arranged at least in sections between the shielding braid of said high-current cable and the stranded insulation. The inside diameter of the cable connection-side, hollow-cylindrical section of the insulating bush can correspond to the outside diameter of the stranded insulation of the high-current cable for this purpose.

The high-current contact element is provided for transmitting high electric currents and, to this end, can in particular also carry particularly high electrical voltages. The high-current contact element, in particular its connection region, is therefore a live component of the high-current connector. A further live part is the electrical conductor, in particular the stranded conductor, of the high-current cable.

In contrast, the cable fastening, in particular cable gland, of the high-current connector and also possibly the preferably at least partially electrically conductive connector housing can carry ground potential. A further part which carries ground potential is the shield, in particular the shielding braid of the high-current cable.

Even if the connector housing is not electrically conductive, that is to say is composed of an electrically insulating plastic for example, at least the cable fastening, in particular cable gland, and the shield fastened to it, for example the shielding braid of the electric high-current cable which is connected to the high-current connector, can be considered to be grounded parts.

Accordingly, for the purpose of assessing the dielectric strength of the high-current connector, the following clearances and creepage paths between live and grounded parts/components should be observed in particular:

an outer creepage path
an inner creepage path
an outer clearance, and
a direct clearance.

For economic reasons, it may be advantageous to configure the two creepage paths to be of the same size. The two clearances can also be embodied to be of the same size, depending on other structural factors. The reason for both is that the electric current seeks the path of least resistance in principle, and therefore an increase in the size of the clearance or creepage path which is respectively large in any case makes no particular sense in terms of the dielectric strength.

With regard to the outer creepage path:

The outer creepage path runs from the connection region of the high-current contact element, across the outer region of the insulating bush, to the shielding braid and/or to the cable fastening, in particular cable gland, which is at ground potential, by way of being in electrical contact, for example, with the shielding braid of the high-current cable.

In an advantageous refinement, the outer creepage path can be increased in size by the shape of an encircling step which is integrally formed on the outside of the funnel-like fastening section. The step can have one or more, that is to say two, three, four, five or six or even more, raised portions for extending the outer creepage path.

Said step ultimately increases the outer surface of the insulating bush and therefore also the distance which possibly has to be covered by a creepage current on the outer surface of the insulating bush in order, for example, to pass from the connection region of the high-current contact element to the cable gland/the shielding braid. In a preferred refinement, at least one, preferably two, of the raised portions which form the step can advantageously additionally also serve to fasten the insulating bush to the connector housing.

Therefore, in a preferred refinement, the step comprises at least one encircling raised portion. The step advantageously has at least two encircling raised portions, specifically a first raised portion and a second raised portion. In this case, the first raised portion, which is arranged in the direction of the cable connection side of the insulating bush, is higher than the second raised portion, which is arranged in the direction of the device connection side of the insulating bush. There is an encircling recess between the two raised portions. As a result, the outer creepage path is extended yet further.

As an alternative or in addition, the step can also comprise an encircling recess. In a particularly preferred refinement, the connection side has at least two, that is to say two, three, four, five, six or more, encircling recesses in order to be able to increase the outer creepage path of the current yet further and, at the same time, to maintain or even reduce the compact design of the connector housing in this way. In a preferred refinement, there are two recesses. In this case, in particular, that recess which is arranged more in the direction of the plug-in side of the insulating bush is deeper than the recess which is arranged more in the direction of the connection side of the insulating bush.

Furthermore, the at least one recess can also serve to fasten the insulating bush to the connector housing.

With regard to the inner creepage path:

The inner creepage path runs inside the insulating bush from the connection region of the high-current contact element, through the hollow-cylindrical section of the insulating bush, to the shielding braid of the high-current cable and is therefore substantially influenced by the length of the hollow-cylindrical section. An increase in the length of the hollow-cylindrical section therefore increases the length of the inner creepage path, without affecting the geometric size of the high-current connector, in particular its connector housing, in the process.

With Regard to the Outer Clearance:

The funnel shape of the fastening section of the insulating bush can serve to extend the outer clearance by way of, put simply, diverting the clearance around the fastening section.

The outer clearance can therefore be increased in size owing to the shape of the funnel-like fastening section. This can be assisted—depending on the specific design—in particular by using a connector housing which is at least partially composed of plastic.

With Regard to the Direct Clearance:

The direct clearance runs along a straight connecting line from the connection region of the high-current contact element to the cable gland/the shielding braid and in so doing crosses the material of the insulating bush.

Therefore, the direct clearance between the connection region and the cable gland can also be increased in size owing to the material thickness in a relevant region of the insulating bush. A direct flashover from the connection region to the cable gland can be prevented in this way. In this case, the relevant region of the insulating bush lies on the direct connecting line which passes from the connection region of the high-current contact element to the cable gland.

Strictly speaking, said direct clearance is not exclusively a pure clearance since the effective electrical length of said direct clearance is determined not only by the air but rather also by the plastic material, in particular the permittivity of said plastic material and the material thickness of said plastic material in the relevant region of the insulating bush. The effective electrical length of the direct clearance is increased in size owing to the plastic material. However, for reasons of consistency, the term "direct clearance" will continue to be used in the text which follows.

The direct clearance can be of particular importance when the connector housing is at least partially composed of an electrically insulating material, for example plastic. However, furthermore, said direct clearance can also be of importance for metal connector housings when, owing to the design of the high-load connector, the cable fastening or the shielding braid is arranged closer to the connection region than the high-current contact element in any grounded, metal region of the connector housing.

Finally, for example for shielding purposes, the connector housing can be at least partially formed from an electrically conductive material, for example from metal, in particular aluminum. In particular, the connector housing can also be formed partially from metal and partially from plastic. In a preferred refinement, the housing can be formed from metal, for example aluminum, on the outside and have a plastic coating or an inner plastic lining or the like on the inside. In this case, the plastic generally serves to reliably preclude a direct electrical connection of the connector housing to current-carrying elements of the high-current connector. In order to be adequately effective against clearances, that is to say flashovers or the like, the plastic material would possibly additionally have to have a sufficient thickness.

If, as mentioned above, the cable fastening/cable gland/the shielding braid is arranged particularly close to the connection region of the high-current contact element for reasons of design, the direct clearance is then initially shorter than the distance from the high-current contact element to the possibly electrically conductive and grounded connector housing. In this case, the material thickness of the insulating bush in the relevant region is of particular importance, and the insulating bush therefore also increases the size of the direct clearance in this case. Otherwise, measures could initially be taken in order to increase the size of the clearance between the high-current contact element and the connector housing.

In order to assist the compactness of the design, in particular in the insertion direction, the connector housing is preferably an angled connector housing. This means that the plug-in side and the connection side are arranged at an angle, in particular a right angle, in relation to one another. For the purpose of space-saving implementation, the high-current contact element can be of two-part design and as a result can render possible a right-angled connecting region which has the particular advantage of a particularly large saving in terms of space in comparison to a curved region.

The preferably metal high-current contact element therefore consists of a first part and a second part which are connected to one another in the connecting region. The first part has a plug-in region which can have a contact pin or a contact socket. The second part is formed from a connection region which has, in particular, a crimp connection or axial screw connection. One of the two parts, preferably the second part, can have a connecting opening for electrical and mechanical connection to the other, preferably the first, part. The respectively other one of the two parts, preferably the first part, has a connecting section which interacts in a mechanically and electrically connecting manner with the connecting opening of the second part and preferably can be accommodated therein in an interlocking and/or force-fitting manner.

Therefore, said right-angled connection of these two parts is aimed for in order to achieve said saving in terms of space. This can be performed by a screw connection in a less preferred refinement and/or by so-called "shrink-fitting" in a particularly preferred refinement.

For the screw connection, the connecting section can have an external thread and the connecting opening can have a matching internal thread, so that the connecting section can be screwed into the connecting opening.

In the particularly preferred refinement however, the electrical and mechanical connection of the two parts is established by said shrink-fitting, that is to say by a shrink-fitting connection. In this case, the technique of shrink-fitting involves that part which has the connecting opening, preferably the second part in this case, being heated, as a result of which the connecting opening expands. The other part, preferably the first part in this case, is then inserted, for example by way of its connecting section, into the connecting opening. Ideally, the connecting opening and the connecting section can have a round cross section in order to engage into one another in an interlocking manner, and therefore the risk of tilting does not exist.

The connecting opening is then reduced in size (shrunk) again by cooling, and therefore the connecting opening surrounds the connecting section in an interlocking and/or force-fitting manner. Therefore, the angled contact—in comparison to a contact which is produced using a bending method and has a corresponding bending radius—can be produced in a right-angled manner, as a result of which the space requirement for the high-current connector reduces, in particular in the insertion direction as well. The holding and contact force of this connection can be particularly large and stable in this way—depending on the material thickness and the material condition.

Said cable fastening, in particular cable gland, which holds the high-current cable on the connector housing, obviously serves primarily for strain relief, that is to say to relieve the connection of the stranded conductor to the connection region of the high-current contact element of mechanical loading in the form of tensile forces.

Furthermore however, the cable fastening, in particular cable gland, possibly also serves for shielded connection to an at least partially metal connector housing. For the purpose of protective grounding to said connector housing, an additional protective grounding contact ("Protection Earth contact"/"PE contact"), which is not described in any detail here however, can usually be provided.

Cable glands are known from the prior art. For example, DE 103 11 473 B3 discloses a cable gland in which strain relief is combined with sealing. The cable fastening is fitted on the connection side of the high-current connector and fastens the high-current cable to the connector housing. In addition, the cable fastening, in particular cable gland, can ensure ground connection of the shielding braid to the high-current connector, in particular the connector housing of said high-current connector.

In a further preferred refinement, the insulating bush has a rotation-prevention means. The rotation-prevention means may be a chamfer or a recess or a molded-on portion on the connection side of the insulating bush. These different variants of the rotation-prevention means latch or lock with the connector housing or are inserted in a corresponding manner. Rotation of the insulating bush in the connector housing is prevented in this way.

Therefore, sufficiently large clearances and creepage paths are ensured by the disclosed insulating bush. At the same time, the entire high-current connector is accordingly also of compact, that is to say space-saving, design and, in particular, also has a comparatively low height in the insertion direction. Furthermore, the insulating bush has a simple design which can therefore be produced in a cost-effective manner.

BRIEF DESCRIPTION OF THE DRAWINGS

An exemplary embodiment of the invention is illustrated in the drawings and will be explained in more detail in the text which follows.

DETAILED DESCRIPTION

The figures contain partially simplified, schematic illustrations. In some cases, identical reference symbols are used for elements which are similar but may not be identical. Different views of similar elements could be scaled differently.

Figure 1:
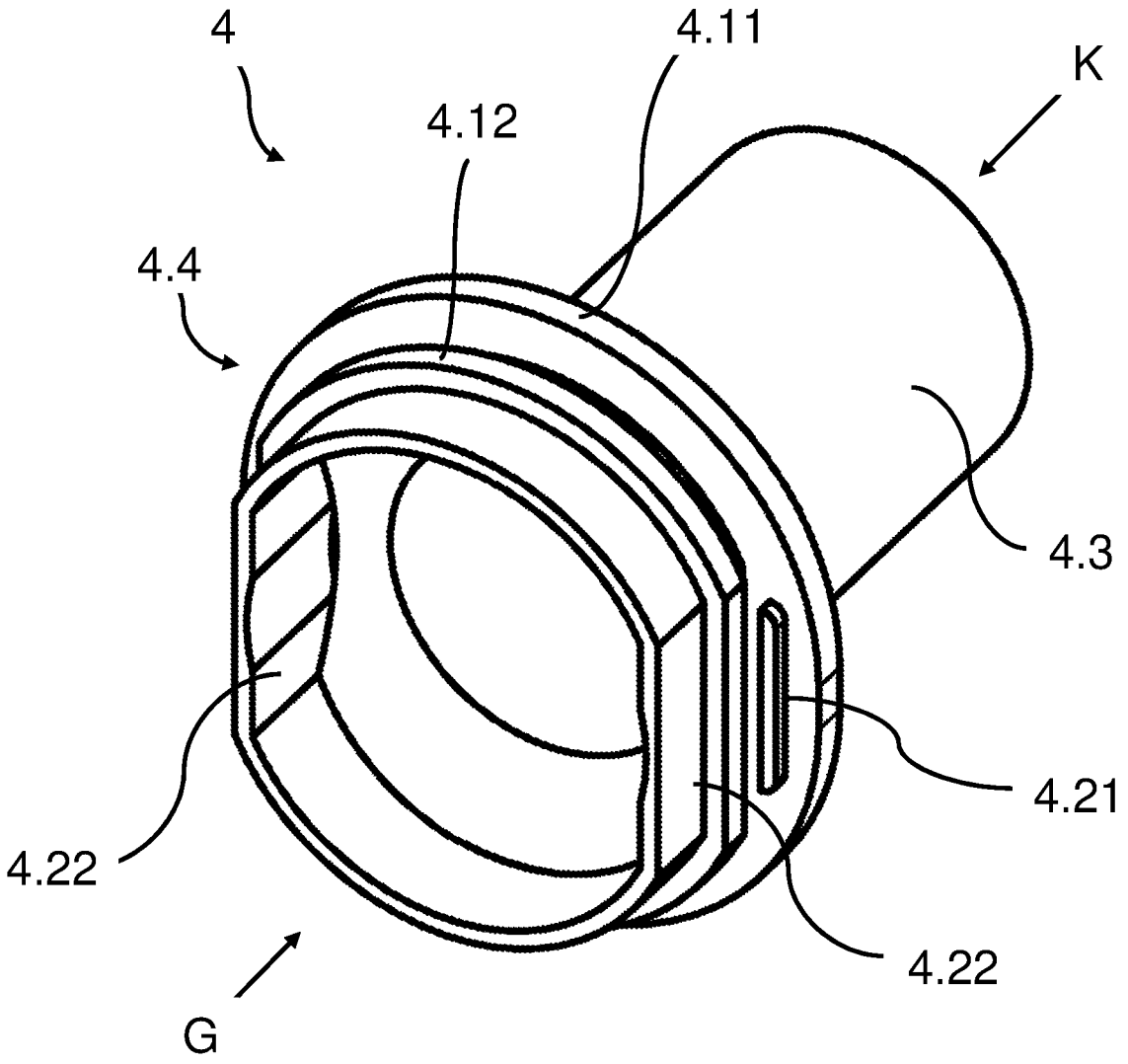
FIG. 1 shows a perspective illustration of an insulating bush.

FIG. 1 shows a perspective illustration of an insulating bush 4. In this illustration, the cable connection side K of the insulating bush 4 is shown at the back right. In the region of its cable connection-side end, the insulating bush 4 has a cylindrical section 4.3.

The housing connection side G of the insulating bush 4 is illustrated at the front left in this illustration, opposite said cable connection side. In the region of its housing connection-side end, the insulating bush 4 has an inside radius which increases in size in the direction of the housing connection-side end.

A step is integrally formed on an outer region of a funnel-like fastening section 4.4 which is formed as a result. In this example, the step is formed from a first raised portion 4.11 and a second raised portion 4.12 and serves to increase the size of an outer creepage path along the surface of the insulating bush 4.

In this case, the first raised portion 4.11 is arranged more in the direction of the cable connection side K of the insulating bush 4 than the second raised portion 4.12. The first raised portion 4.11 is higher than the second raised portion 4.12 which is arranged comparatively more in the direction of the housing connection side G of the insulating bush 4. The two raised portions 4.11, 4.12 can additionally serve to fasten the insulating bush 4 to the connector housing 2.

Furthermore, the insulating bush 4 has, on its housing connection side G, a first rotation-prevention means 4.21 and a second rotation-prevention means 4.22. The first rotation-prevention means 4.21 is a molding on the first raised portion 4.11, wherein the molding 4.21 points in the direction of the housing connection side G and therefore is arranged between the two raised portions 4.11, 4.12. The second rotation-prevention means 4.22 is a recess with a chamfer which is arranged on the housing connection-side end of the insulating bush and has both an inner and an outer contour. Therefore, in this example, at least two types of rotation-prevention means 4.21, 4.22 are shown, but the use of, for example, only the first rotation-prevention means 4.21 or only the second rotation-prevention means 4.22 is also possible.

Figure 2:
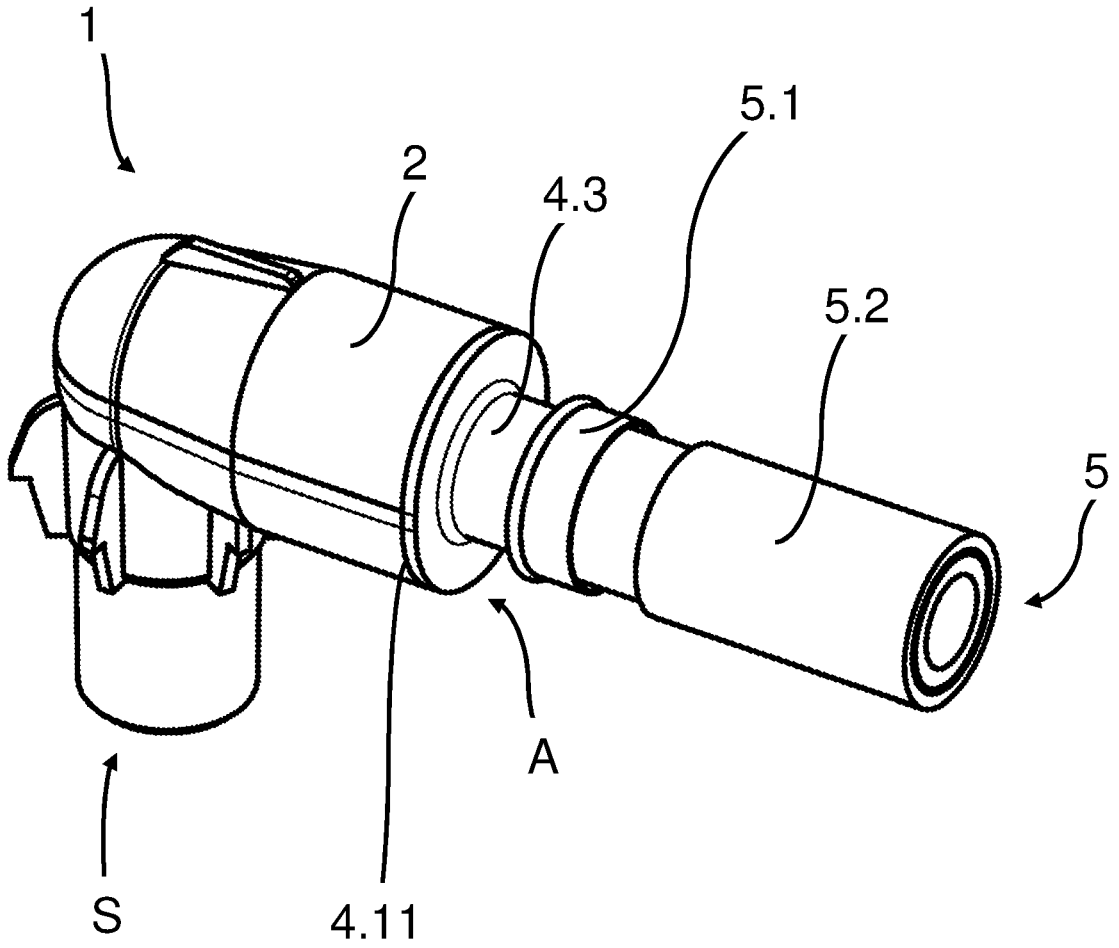
FIG. 2 shows a perspective illustration of a high-current connector comprising the insulating bush and a connected high-current cable.

FIG. 2 shows a perspective illustration of a high-current connector 1. The high-current connector 1 has a plug-in side S and a connection side A. The plug-in side S and the connection side A are arranged at a right angle in relation to one another.

Therefore, the high-current connector 1 has an angled connector housing 2. A high-current contact element 3 is accommodated in the connector housing 2, which high-current contact element is concealed by the connector housing 2 in this illustration and therefore is not visible. However, the high-current contact element 3 can be clearly seen in FIG. 3. The insulating bush 4 is attached to the connector housing 2 on the connection side A, wherein only the hollow-cylindrical section 4.3 and the first raised portion 4.11 of the insulating bush 4 can be seen in this illustration.

A high-current cable 5 is passed, by way of its end which is stripped of sheathing, through the insulating bush 4. In the region which is stripped of insulation, the insulating bush 4 is pushed, by way of its hollow-cylindrical section 4.3, beneath a shielding braid 5.1 of the high-current cable 5. The shielding braid 5.1 is bent back through 180° in the connection region. In this region, the high-current cable 5 can be fastened to the connector housing 2 by means of a cable fastening, not illustrated in the drawing, specifically a cable gland, for the purpose of strain relief and possibly for the purpose of ground connection.

Figure 3:
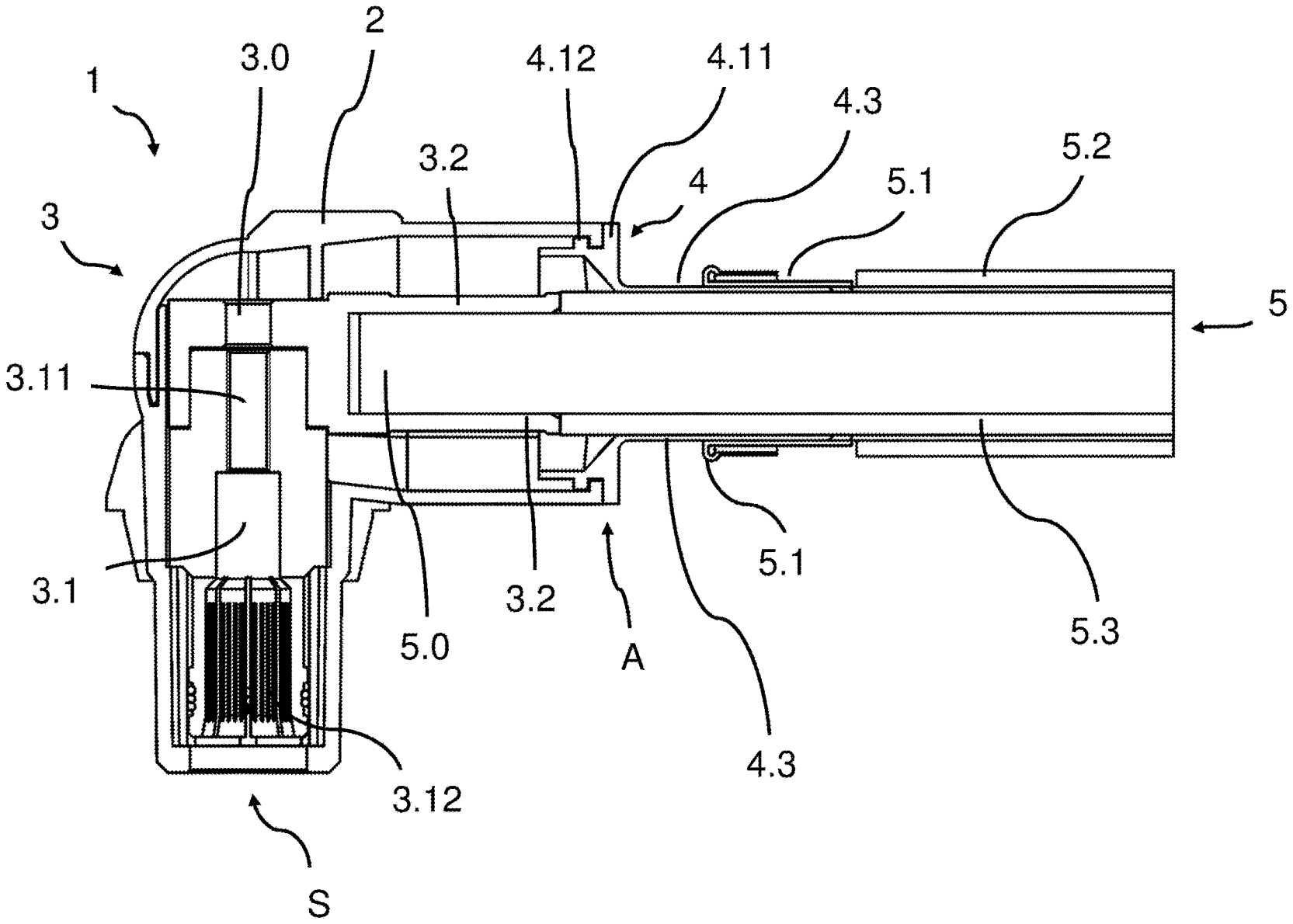
FIG. 3 shows a sectional illustration through the high-current connector comprising the insulating bush and the high-current cable.

FIG. 3 shows a sectional illustration of the above arrangement.

In this illustration, the high-current cable 5 can be clearly seen in cross section. In the interior, said high-current cable has an electrical conductor in the form of a stranded conductor 5.0. The stranded insulation 5.3, which is removed from the connection side, that is to say the high-current cable 5 is stripped of insulation on the connection side, is located over said stranded conductor. The shield in the form of a shielding braid 5.1 is usually located on the stranded insulation. The sheath 5.2 of the high-current cable 5 is located over said shielding braid. The high-current cable 5 is partially stripped of sheathing on the connection side. The region which is stripped of sheathing is larger than that region which is stripped of insulation. In the intermediate region which is formed as a result, the shielding braid is exposed in a subsection and can be bent away through 180° from the connection region, as is illustrated in the drawing.

Furthermore, the two-part high-current contact element 3 of the high-current connector 1 can be clearly seen in this sectional illustration.

A plug-in region 3.1 with a connecting section 3.11 and a plug-in contact 3.12, which is embodied as a socket contact, that is to say is provided with a contact socket, in this case, forms part of the high-current contact element 3. In another embodiment, the plug-in region 3.1 could instead be provided with a pin contact in the same way, that is to say the plug-in contact 3.12 could be embodied as a contact pin.

Furthermore, the high-current contact element 3 has a connection region 3.2 which is embodied using crimping technology in this case. In a further embodiment however, said connection region may be an axial screw connection. The connection region 3.2 has a round connecting opening 3.0, in which the cylindrical connecting section 3.11 of the plug-in region 3.1 is held in an interlocking and force-fitting manner, for the purpose of connection to the plug-in region. The stranded conductor 5.0, which is stripped of insulation, of the high-current cable 5 is electrically conductively connected to the connection region 3.2 of the high-current contact element 3 in the form of a crimp connection or an axial screw connection for power transmission within the high-current connector 1.

As already explained with respect to FIG. 1, the insulating bush 4 has, in its funnel-like fastening section 4.4, a step in the form of two raised portions 4.11, 4.12. A recess, not specifically designated, is formed between the two raised portions 4.11, 4.12. An internally encircling molded-on fastening portion, not specifically designated, of the connector housing 2 latches into said recess and in this way fixes the insulating bush 4 to the connector housing 2. The rotation-prevention means 4.21, 422 cannot be identified in this illustration.

It is easy to imagine that the clearances and creepage paths between the connection region 3.2 and the stranded conductor 5.0 on one side and the cable braid 5.1 and the cable gland on the other side is extended by the insulating bush 4. Finally, the shortest outer electrical path leads through the air from the connection region 3.2, past the funnel-like fastening section 4.4, on a clear diverted path to the cable braid 5.1. The direct clearance passes through the insulating bush and undergoes an effective electrical extension due to the plastic material of said insulating bush in line with the associated permittivity.

The outer creepage path, which the step in the form of the two raised portions 4.11 and 4.12 has to pass through, is also increased in size, that is to say covers a substantially larger distance in order to pass from the connection region 3.2 to the cable braid 5.1.

On the cable connection side, the insulating bush 4 is pushed, by way of its hollow-cylindrical section 4.3, onto the stranded insulation 5.3 and is arranged, at least in regions, between the shielding braid 5.1 and the stranded insulation 5.3. As a result, the inner creepage path between the stranded conductor 5.0, which is stripped of insulation, and the shielding braid 5.1 of the high-current cable 5 is also increased in size. Finally, the creepage current cannot flow directly from the connection region of the high-current contact element 3 to the shielding braid, but rather it first has to completely pass through the cylindrical molding 4.3.

It can be clearly seen that the outer and the inner creepage path are of approximately the same length. This is expedient since the creepage current would seek the shortest path in any case.

The same also applies, in principle, to the inner and the (effective) direct clearance, wherein the material thickness of the insulating bush 4 in the relevant region can also be somewhat thicker for reasons of stability. However, this cannot be so easily understood with reference to the drawing since the length of the effective direct clearance does not correspond to its geometric length.

In the present embodiment, the cable braid 5.1 is also illustrated in a manner removed relatively far away from the connection region 3.2 for reasons of clarity. If the connector housing 2 is a plastic housing, the distance between the connection region 3.2 and the cable braid 5.1, which is bent back through 180°, is then nevertheless relevant for the clearances and creepage paths. If, however, said connector housing is an at least partially metal connector housing 2, this distance can then nevertheless also be relevant for the direct clearance, provided that the effective clearance between the high-current contact element 3 and the electrically conductive regions of the connector housing 2 is greater.

Therefore, a compact design of the high-current connector 1 is rendered possible by the insulating bush 4. Finally, a comparable high-current connector without this insulating bush 4 would have to have substantially larger dimensions for achieving correspondingly large clearances and creepage paths. Conversely, this means that the dimensions of the connector 1 are particularly compact owing to the insulating bush 4.

Even though various aspects or features of the invention are shown respectively in combination in the figures, it is clear to a person skilled in the art—unless stated otherwise—that the illustrated and discussed combinations are not the only ones possible. In particular, mutually corresponding units or feature complexes from different exemplary embodiments can be exchanged with one another.

LIST OF REFERENCE SYMBOLS

1 High-current connector
2 Connector housing
3 High-current contact element
3.0 Connecting opening
3.1 Plug-in region
3.11 Connecting section
3.12 Plug-in contact
3.2 Connection region
4 Insulating bush
4.11 First raised portion
4.12 Second raised portion
4.21 First rotation-prevention means
4.22 Second rotation-prevention means
4.3 Hollow-cylindrical section
4.4 Fastening section
5 High-current cable
5.0 Stranded conductor
5.1 Shielding braid
5.2 Sheath
5.3 Stranded insulation
K Cable connection side of the insulating bush
G Housing connection side of the insulating bush
S Plug-in side of the high-current connector
A Connection side of the high-current connector

The invention claimed is:

1. A high-current connector (1), having
a connector housing (2) and
a high-current contact element (3),
wherein the high-current connector (1) has a plug-in side (S) and a connection side (A),
wherein the high-current contact element (3) is arranged in an interior of the connector housing (2),
wherein the high-current contact element (3) has a plug-in region (3.1) and a connection region (3.2),
wherein an electrical conductor (5.0) of a high-current cable (5) can be connected to the connection region (3.2),
wherein the high-current cable (5) can be fastened to the connection side (A) of the high-current connector (1) by a cable fastening,
wherein the high-current connector (1) comprises an insulating bush (4) which is or can be fastened to the connection side, and
wherein the insulating bush (4) has
a cable connection-side hollow-cylindrical section (4.3) and
a housing connection-side funnel-like fastening section (4.4)
for maintaining prespecified clearances and creepage paths.

2. The high-current connector (1) as claimed in claim 1, wherein an encircling step (4.11, 4.12) is integrally formed on an outer side of the fastening section (4.4).

3. The high-current connector (1) as claimed in claim 2, wherein the encircling step comprises at least one encircling raised portion (4.11, 4.12).

4. The high-current connector (1) as claimed in claim 2, wherein the encircling step (4.1) comprises at least one encircling recess.

5. The high-current connector (1) as claimed in claim 1, wherein the hollow-cylindrical section (4.3) of the insulating bush (4) can be introduced between a stranded insulation (5.3) and a shielding braid (5.1) of the high-current cable (5).

6. The high-current connector (1) as claimed in claim 1, wherein the cable fastening is a cable gland.

7. The high-current connector (1) as claimed in claim 1, wherein the insulating bush (4) has at least one rotation-prevention means (4.21, 4.22).

8. The high-current connector (1) as claimed in claim 1, wherein the insulating bush (4) is composed of an electrically insulating plastic.

9. The high-current connector (1) as claimed in claim 1, wherein the high-current connector (1) is of angled design.

10. The high-current connector (1) as claimed in claim 1, wherein the high-current contact element (3) is of two-part design.

11. The high-current connector (1) as claimed in claim 10, wherein the plug-in region (3.1) and the connection region (3.2) are separate element, both being composed of metal.

12. The high-current connector (1) as claimed in claim 11, wherein the plug-in region (3.1) and the connection region (3.2) are electrically and mechanically connected to one another by a screw connection or by a shrink-fitting connection.

13. The high-current connector (1) as claimed in claim 10, wherein the plug-in region (3.1) and the connection region (3.2) are connected to one another at a right angle.

14. The high-current connector (1) as claimed in claim 1, wherein the connector housing (2) is at least partially formed from an electrically insulating plastic.

15. The high-current connector (1) as claimed in claim 1, wherein the connector housing (2) is at least partially composed of an electrically conductive material.

16. The high-current connector (1) as claimed in claim 15, wherein the connector housing (2) is at least partially composed of metal.

* * * * *